US008851774B2

(12) United States Patent
Rolion et al.

(10) Patent No.: US 8,851,774 B2
(45) Date of Patent: Oct. 7, 2014

(54) RETRACTABLE-POINT WRITING IMPLEMENT

(75) Inventors: Franck Rolion, Asnieres sur Oise (FR); Franck Vadenne, Bezons (FR)

(73) Assignee: Societe BIC, Clichy (FR)

( * ) Notice: Subject to any disclaimer, the term of this patent is extended or adjusted under 35 U.S.C. 154(b) by 790 days.

(21) Appl. No.: 13/121,519

(22) PCT Filed: Oct. 2, 2009

(86) PCT No.: PCT/FR2009/051876

§ 371 (c)(1),
(2), (4) Date: Jun. 9, 2011

(87) PCT Pub. No.: WO2010/037982

PCT Pub. Date: Apr. 8, 2010

(65) Prior Publication Data

US 2011/0236120 A1 Sep. 29, 2011

(30) Foreign Application Priority Data

Oct. 3, 2008 (FR) ..... 08 56731

(51) Int. Cl.
*B43K 24/04* (2006.01)
*B43K 5/16* (2006.01)
*B43K 7/00* (2006.01)

(52) U.S. Cl.
CPC . *B43K 24/04* (2013.01); *B43K 7/00* (2013.01); *B43K 7/005* (2013.01); *B43K 5/16* (2013.01)
USPC ..... 401/117; 401/99

(58) Field of Classification Search
USPC ..... 401/99, 117
See application file for complete search history.

(56) References Cited

U.S. PATENT DOCUMENTS

| | | | | |
|---|---|---|---|---|
| 3,985,455 | A | 10/1976 | Wahlberg | |
| 4,717,275 | A | 1/1988 | Burkhardt, Jr. | |
| 4,780,016 | A * | 10/1988 | Kim | 401/117 |
| 5,564,849 | A | 10/1996 | Greer, Jr. | |
| 5,613,300 | A * | 3/1997 | Schmidt | 30/2 |
| 6,290,413 | B1 | 9/2001 | Wang | |

(Continued)

FOREIGN PATENT DOCUMENTS

| | | |
|---|---|---|
| FR | 2 906 756 | 4/2008 |
| WO | WO 2008-040912 A2 | 4/2008 |

OTHER PUBLICATIONS

French Preliminary Search Report of FR 0856731, 2010.

*Primary Examiner* — David Walczak
*Assistant Examiner* — Joshua Wiljanen
(74) *Attorney, Agent, or Firm* — Jones Day

(57) ABSTRACT

A writing implement that includes a barrel extending in a longitudinal direction; a writing cartridge provided at one front end with a tip and designed to be moved in the barrel in the longitudinal direction between a forward position in which the tip is extended and a retracted position in which the tip is retracted into the barrel; a push member movable in the longitudinal direction and in a radial direction relative to the barrel, connected to the cartridge in order to move the latter, that includes at least one control member extending through an opening in the side of the barrel in order to project radially outwards, and also including at least one locking member designed to cooperate with a complementary locking member of the barrel allowing the push member to be locked in the forward position of the cartridge.

12 Claims, 4 Drawing Sheets

(56) References Cited

U.S. PATENT DOCUMENTS 6,755,584 B2 * 6/2004 O'Brien et al. ..... 401/117
8,079,767 B2 * 12/2011 Rolion et al. ..... 401/107
2010/0183354 A1 * 7/2010 Llatch et al. ..... 401/17

* cited by examiner

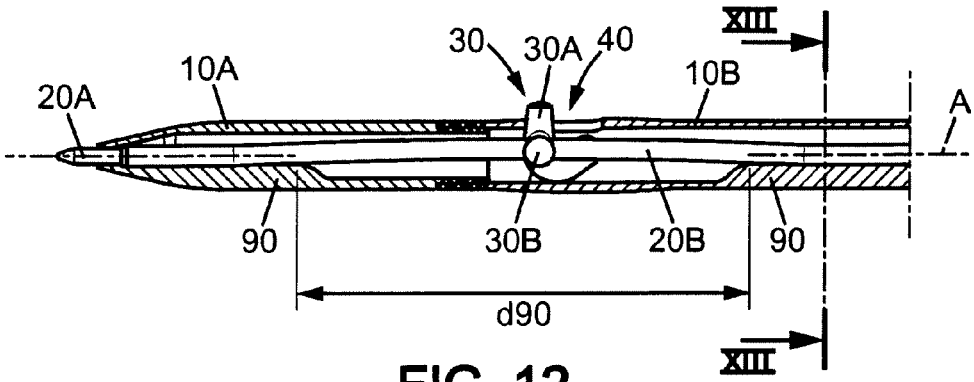
FIG. 12
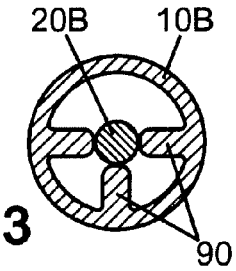
FIG. 13
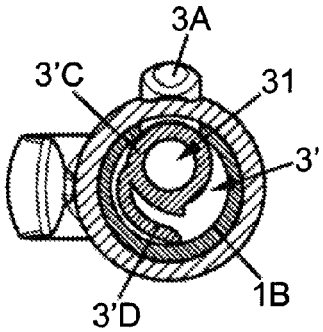
FIG. 14
FIG. 15
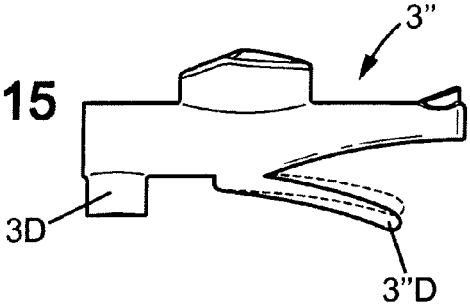

RETRACTABLE-POINT WRITING IMPLEMENT

CROSS REFERENCE TO RELATED APPLICATION

This application is a national stage application of International Application No. PCT/FR2009/051876, filed on Oct. 2, 2009, which claims the benefit of French Patent Application No. 0856731 filed on Oct. 3, 2008, the entire contents of both applications being incorporated herein by reference.

FIELD OF THE INVENTION

The embodiments of the present invention relate to a writing implement that includes:

a barrel extending in a longitudinal direction;

a writing cartridge provided at a front end with a tip and designed to be moved in the barrel in the longitudinal direction between a forward position in which the tip is extended and a retracted position in which the tip is retracted into the barrel;

a push member movable in the longitudinal direction and in a radial direction relative to the barrel, connected to the cartridge in order to move the latter, comprising at least one control member extending through an opening in the side of the barrel to project radially outwards, and also comprising at least one locking member designed for engaging with a complementary locking member of the barrel allowing the push member to be locked in the forward position of the cartridge.

BACKGROUND OF THE INVENTION

Such a device is known in particular from the U.S. Pat. No. 4,717,275 ("the '275 patent). The push member incorporates flexible tabs ensuring a radially directed elastic return force for the locking of the push member, which makes it possible to dispense with a metal return spring fitted longitudinally in a standard fashion at the front of the barrel between an inner wall of the barrel and the cartridge. However, the writing implement described in the '275 patent requires that the cartridge be fitted in a mobile support possessing a housing suitable for receiving these flexible tabs. This cartridge support complicates the manufacture of the implement and increases its cost. Moreover, this device means that the push member occupies almost the entire width of the barrel and as a result is fitted behind the ink reservoir at the rear of the barrel.

SUMMARY OF THE EMBODIMENTS OF THE PRESENT INVENTION

The embodiments of the present invention aim to remedy these drawbacks and to provide an economical writing implement which is simple to manufacture due in particular to the absence of metal return spring. The invention also aims to allow an arrangement of the push member typically towards the middle of the barrel or further forward, in order to improve the ergonomics of the cartridge actuating device.

To this end, a subject of the embodiments of the present invention is a writing implement as defined in the preamble, characterized in that a flexible tubular part of the cartridge is preferably movable jointly with the push member and forms an elastic return member designed to exert on the push member a force directed outwards from the barrel such as to bring about the locking.

Thanks to these arrangements, it is no longer necessary for the push member to incorporate an elastic return member for its locking, which makes it possible to have a push member directly fitted on a flexible tubular part of the cartridge and to dispense with an additional support part for the cartridge as in the device of the '275 patent. Moreover, even to provide an embodiment according to the invention in which an additional elastic return member is incorporated in the push member in order to provide an additional elastic return force which will complete the force created by the bending of the cartridge tube, this elastic member can occupy a small enough space to retain a push member which can be fitted around a portion of the cartridge tube and inserted into the barrel.

An embodiment of the present invention is directed to a writing implement that includes a barrel extending in a longitudinal direction. A writing cartridge is provided at one front end with a tip and is designed to be moved in the barrel in the longitudinal direction between a forward position in which the tip is extended and a retracted position in which the tip is retracted into the barrel; a push member movable in the longitudinal direction and in a radial direction relative to the barrel, connected to the cartridge in order to move the latter, comprising at least one control member extending through an opening in the side of the barrel in order to project radially outwards, and also comprising at least one locking member designed to cooperate with a complementary locking member of the barrel allowing the push member to be locked in the forward position of the cartridge; wherein a flexible tubular part of the cartridge is movable jointly with the push member and forms an elastic return member designed to exert on the push member a force directed outwards from the barrel making it possible to bring about the locking.

BRIEF DESCRIPTION OF THE DRAWINGS

Other characteristics and advantages will become apparent from the following description of non-limitative embodiments of the present invention, with reference to the figures, in which:

FIG. 12 diagrammatically shows a partial longitudinal sectional view of the writing implement according to the second embodiment.

FIG. 13 diagrammatically shows a cross-sectional view of the writing implement along the section plane XIII-XIII of FIG. 12.

FIG. 14 diagrammatically shows another embodiment of a push member for a writing implement according to the invention.

FIG. 15 diagrammatically shows another embodiment of a push member for a writing implement according to the invention.

DETAILED DESCRIPTION OF THE EMBODIMENTS OF THE PRESENT INVENTION

Figure 1:
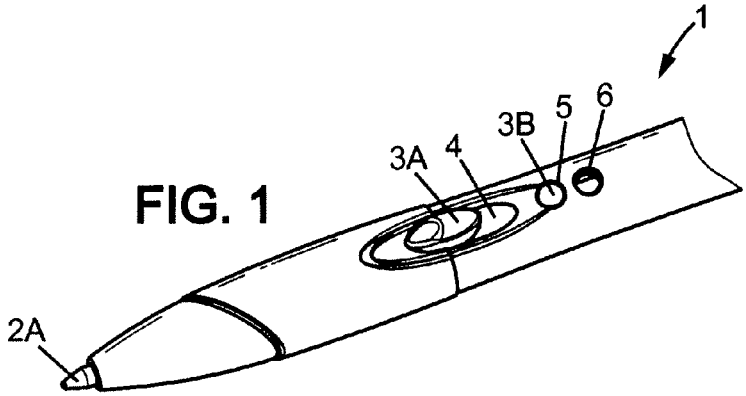
FIG. 1 diagrammatically shows a partial perspective view of a writing implement according to a first embodiment of the invention.
Figure 2:
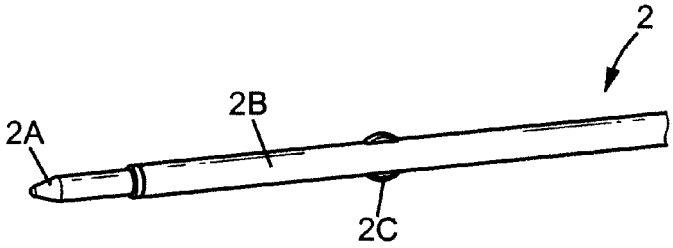
FIG. 2 diagrammatically shows a partial perspective view of the ink cartridge of the writing implement according to the first embodiment of the invention.
Figure 3:
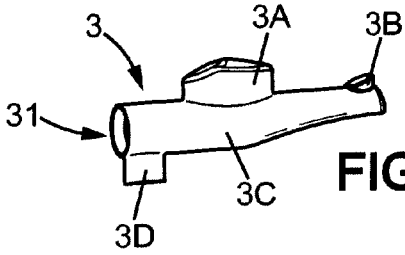
FIG. 3 diagrammatically shows a perspective view of the push member according to the first embodiment.
Figure 4:
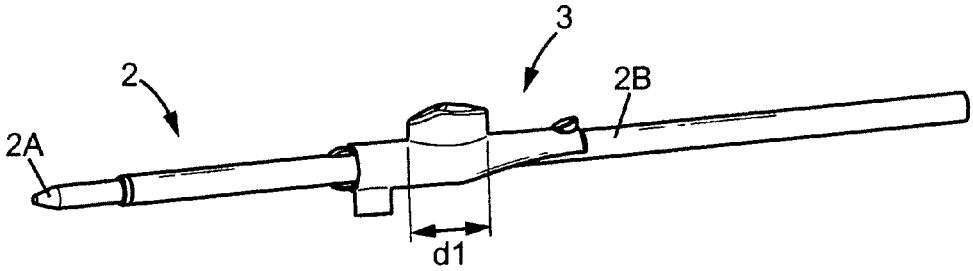
FIG. 4 diagrammatically shows a perspective view of the push member of FIG. 3 fitted on the cartridge of FIG. 2.

In FIGS. 1 to 7, the writing implement according to a first embodiment of the present invention includes a generally cylindrical barrel 1 having an opening 4 in the side through which a control member 3A of a push member 3 extends. The barrel 1 houses an ink cartridge 2 movable jointly with the push member 3, including a writing tip 2A and an ink reservoir formed by a tube 2B made of flexible and resilient plastic material. The push member 3 comprises a generally tubular part 3C having a hole extending through 31 suitable for allowing the tube 2B to pass until protuberances 2C formed on the tube abut against a flared opening at the front of the hole 31. The diameter of the hole 31 is provided such that the push member 3 grips the tube at least sufficiently firmly for the latter to be held to a certain extent and at the very least unable to slide into the hole 31 under the action of its weight alone. Alternatively, it is possible to provide latching means for holding the push member 3 in position on the tube 2B.

The push member 3 also comprises a control member 3A in the form of a button projecting radially from an outer surface of the generally cylindrical part 3C and a locking member 3B in the form of a beveled cylindrical pin provided on the rear end of the part 3C in longitudinal alignment with the control member 3A. Another protruding element 3D, the function of which will be explained with respect to FIG. 6, projects radially from a front end of the generally tubular part 3C in the opposite direction to the control and locking members.

A first hole 5 and a second hole 6 are formed in the barrel 1 behind the opening 4 in the side and in alignment with the latter, and are respectively suitable for receiving the locking member 3B of the push member 3 when the cartridge 2 is situated respectively in a forward position in which the tip 2A is extended and in a retracted position in which the tip is retracted and protected by the barrel.

Figure 5:
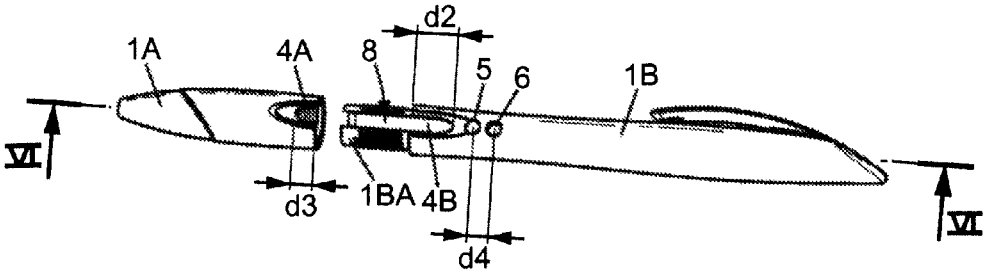
FIG. 5 diagrammatically shows an exploded perspective view of the barrel of the writing implement according to the first embodiment.

The control member 3A projects radially beyond the outer wall of the barrel 1 in order to be easily actuated by the user. Advantageously, in order to allow the fitting of the push member 3 in the barrel 1, the latter comprises a main part 1B and a head part 1A designed to be assembled together, for example by screwing means as represented in FIG. 5. The control member 3A is substantially oval in shape here for aesthetic reasons in particular, and as a result the opening 4 in the side of the barrel has end edges of corresponding shapes. In this configuration, in order to limit the length of the opening 4 in the side, it is advantageous to provide that this opening has a first portion 4B formed on the main part 1B of the barrel and a second portion 4A formed on the head part 1A of the barrel.

In order not to impede the screwing of the head part 1A onto the main part 1B, it is advantageous that the first portion 4B has an extent d2 in the longitudinal direction at least equal to the extent d1 of the control member 3A in this direction. If the distances d1 and d2 are provided equal, as is the case in the embodiment shown, the extent d3 of the second portion 4 A of the opening 4 in the side must be at least equal to the distance d4 which separate the centers of the first and second holes 5 and 6 and which is equal to the translational travel of the cartridge 2 between the forward position and the retracted position. In the embodiment shown, the distances d3 and d4 are provided equal. In this way, as can be seen in FIG. 6, the control member 3A comes to rest virtually against the front end edge of the opening 4 in the side when the locking member 3B is engaged in the first hole 5, the cartridge 2 then being in the forward position.

Figure 6:
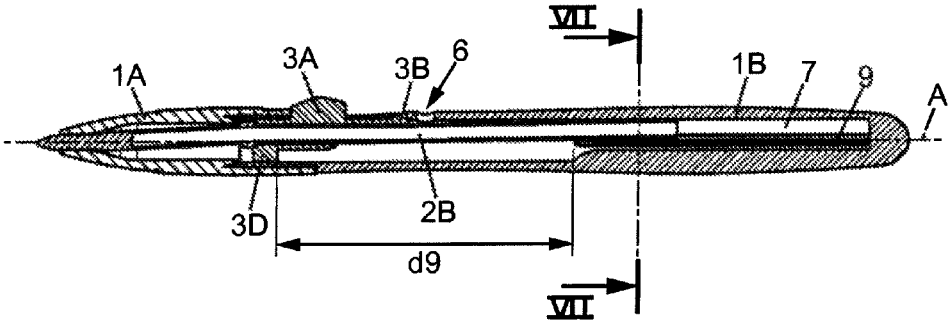
FIG. 6 diagrammatically shows a longitudinal sectional view of the writing implement according to the first embodiment.

In FIG. 6, it appears that the protruding element 3D of the push member 3 constitutes a front radial adjustment means of the cartridge 2, in that at its level it makes it possible to limit the radial movement relative to the central longitudinal axis A of the flexible tube 2B. This protruding element 3D is designed to rest permanently against an inner wall of the barrel 1, so that a thrust exerted on the control member 3A and directed radially inwards causes the push member 3 to pivot substantially about the element 3D in the plane of FIG. 6. The flexibility of the cartridge tube 2B allows a sufficient displacement of the locking member 3B in the radial direction during the pivoting of the push member 3, in order to allow the engagement or disengagement of the locking member 3B in a hole 5 or 6.

The main part 1B of the barrel comprises in front of the first portion 4B of the opening 4 in the side a tubular fixing part 1BA provided with fixing means for assembly with the head part 1A. This tubular fixing part 1BA has a slot 8 which extends longitudinally in the extension of the first portion 4B and is wide enough for the button forming the control member 3A to pass through during fitting.

Figure 7:
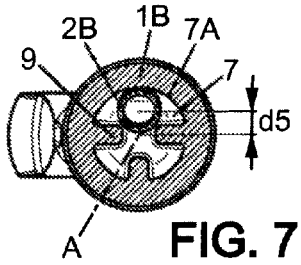
FIG. 7 diagrammatically shows a cross-sectional view along the section plane VII-VII of FIG. 6.
Figure 8:
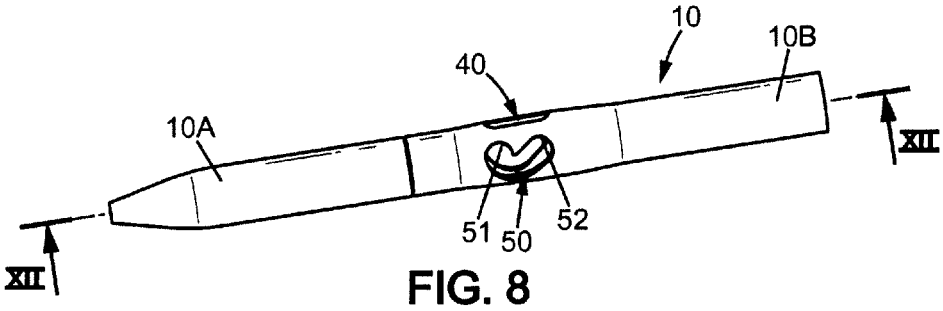
FIG. 8 diagrammatically shows a perspective view of the barrel of a writing implement according to a second embodiment of the invention.
Figure 9:
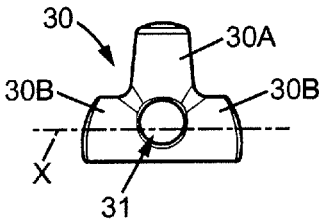
FIG. 9 diagrammatically shows a cross-sectional view of the push member of the writing implement according to the second embodiment.

As shown in FIGS. 6 and 7, a rear portion of the barrel includes a housing 7 which extends parallel to the central longitudinal axis A. A rear portion of the cartridge tube 2B behind the push member 3 is suitable for sliding in translation in the housing 7 and is held radially at a distance from the axis A on the same side of the barrel 1 as the opening 4 in the side. The housing 7 is delimited in particular by two diametrically opposite ribs 9 which extend longitudinally and project radially towards the inside of the barrel from a cylindrical inner wall 7A of the barrel. The ribs 9 constitute a rear radial adjustment means of the cartridge tube 2B, and are spaced relative to the front adjustment means constituted by the protruding element 3D at a sufficient distance d9 for an intermediate portion of the cartridge tube 2B to change shape by bending while remaining within the limit of a completely elastic deformation during the radial movement of the push member 3.

FIGS. 8 to 13 represent a second embodiment of a writing implement according to the invention. The barrel 10, generally cylindrical in form, shown in FIG. 8 has a first oblong hole 40 forming a opening to allow the push element 30A of the push member 30 represented in FIG. 9 to slide, and moreover has two second profiled oblong holes 50 on opposite sides each extending through a wall of the barrel on either side of the first hole 40.

The push member 30 is intended to be introduced into the barrel through one or other one of the oblong holes 50, and includes two locking elements 30B on opposite sides constituted by two cylindrical protuberances which extend forming a generally cylindrical single volume along a transverse axis X perpendicular to the longitudinal direction of the barrel 10. It also includes a control member 30A in the form of a button projecting between the two locking elements 30B perpendicular to the transverse axis X. The complementary locking elements of the barrel are each formed by an edge portion in the form of an arc of circle 51 of an oblong hole 50, each oblong hole 50 forming a cam channel along which a locking member 30B is guided when the push member 30 is moved in order to actuate the cartridge 20 between a forward position and a retracted position.

Figure 10:
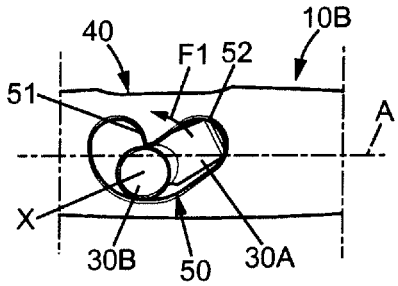
FIG. 10 diagrammatically shows a partial longitudinal sectional view of the barrel of FIG. 8 in which the push member of FIG. 9 is introduced during fitting.

As shown in FIG. 10, the push member 30 is introduced into the barrel 10 before being connected to the cartridge 20. The dimensions of an oblong hole 50 are suitable for a single inclined position for introduction of the push member 30, which once in place in the barrel is made to pivot in the direction of the arrow F1 relative to the transverse axis X until a cylindrical hole 31 provided in the push member 30 for the cartridge 20 to pass through is oriented in the longitudinal direction. The cartridge 20 is then introduced into the barrel 10 and passed through the cylindrical hole 31 in the direction of introduction of the arrow F2, until the push member 30 reaches a specific position in which it is held in position on the cartridge by holding means, not shown, which can be analogous to those described in the first embodiment. Advantageously, the barrel 10 includes two separable respectively front and rear part 10A and 10B, and the cartridge 20 is introduced into the rear part 10B prior to the fitting of the front part 10A.

In FIG. 12, the writing implement according to this second embodiment is shown in longitudinal cross-section in the forward position of the cartridge 20. Thanks to the cooperation between each locking member 30B and a complementary locking member formed by the edge portion in the form of an arc of circle 51 of an oblong hole 50, the push member 30 is in a locked position which makes it possible to hold the cartridge 20 in position while the writing tip 20A rests on a surface.

Figure 11:
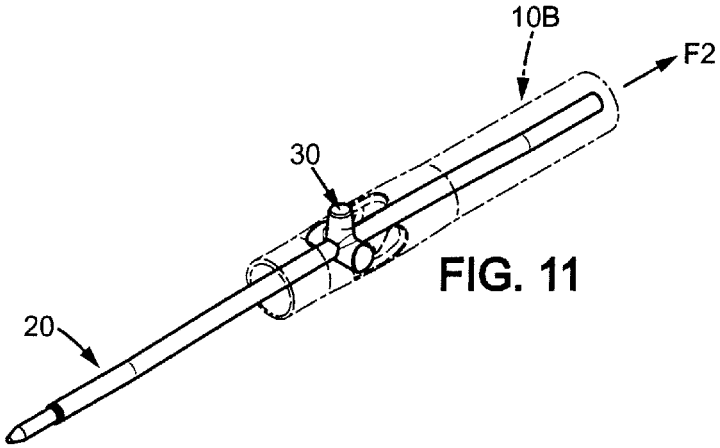
FIG. 11 diagrammatically shows a perspective view of the fitting of a cartridge in the push member according to the second embodiment.

In the embodiment shown, the flexible tube 20B of the cartridge is preformed during manufacture with a predetermined curvature in a longitudinal plane, as can be seen in the plane of FIGS. 11 and 12. This arrangement is advantageous in particular in order to allow each oblong hole 50 to have an opening section which extends over virtually the entire diameter of the cylindrical inner wall of the barrel 10. In this configuration, the tube 20B must be connected to the push member 30 above the bottom end surface of the locking elements 30B so as not to impede the movement of the member 30. During manufacture, the forming of the curvature of the cartridge tube 20B can be provided so as to correspond to the actual curvature exhibited by this tube in the locking position of the cartridge shown in FIG. 12, or can also be provided greater so that the curved portion of the tube provides in this locking position a thrust directed outwards against the push member 30.

It is understood that the cartridge tube 20B can also be formed completely straight in this second embodiment, for example by lowering the position of the hole 31 on the push member 30 or by providing cam channels which extend less far transversally seen in the plane of FIG. 12.

A front radial adjustment means and a rear radial adjustment means each constituted by ribs 90 extending longitudinally on either side of the position of the control member 30A are provided in order to limit at their respective levels the radial movement of the cartridge tube 20B, while holding a front portion and a rear portion of the tube 20B substantially in alignment with the central longitudinal axis A. The front radial adjustment ribs and the rear radial adjustment ribs are spaced apart at a distance d90 sufficient for an intermediate portion of the cartridge tube 20B to change shape by bending while remaining within the limit of a completely elastic deformation during the movement of the push member 30.

FIG. 13 represents a sectional view according to the plane XIII-XIII of FIG. 12, at the level of the rear radial adjustment ribs 90. It will be noted that here the front radial adjustment ribs are provided analogous to the rear ribs, i.e. such that a sectional view along a plane at their level is analogous to the view of FIG. 13. It is understood that the height of that of the three ribs 90 which fixes the radial adjustment position of the cartridge tube 20B can be provided so as to radially shift this position relative to the central longitudinal axis A.

FIG. 14 represents a first variant of a push element according to the first embodiment of the invention, the modified push element 3' being shown in cross-sectional view. The main modification compared with the push element 3 of FIG. 3 relates to the protruding element 3D which is replaced by a flexible tab 3'D substantially forming in section an arc of circle which extends longitudinally under the push element 3A. This tab 3D rests against the inner wall of the barrel 1 and exerts on the push member 3' an additional elastic return force supplementing the force provided by the flexible cartridge tube when the push member 3' is shifted radially. Unlike the push member 3, the push member 3' need not necessarily pivot in a longitudinal plane in order to disengage the locking member 3B.

Another variant of the push member according to the first embodiment of the present invention is shown seen in longitudinal section in FIG. 15. In relation to the push member 3 of FIG. 3, a resilient flexible tab 3"D is added behind the protuberance 3D, and makes it possible to reinforce the elastic return force exerted on the push member 3" when the latter is made to pivot in the plane of the figure relative to the protruding element 3D.

In preferred embodiments of a writing implement according to the present invention, one or other of the following arrangements in particular is used.

the writing implement includes a front radial adjustment means and a rear radial adjustment means of the cartridge arranged in the barrel on either side of the position of the control member and designed to limit at their respective levels the movement of the flexible tubular part in the radial direction during the movement of the push member, which makes it possible to optimize the force that the flexible tubular part exerts on the push member with a certain deflection in a fashion analogous to a leaf spring;

the writing implement includes a front radial adjustment means and a rear radial adjustment means of the cartridge arranged in the barrel on either side of the position of the control member and designed to limit at their respective levels the movement of the flexible tubular part in the radial direction during the movement of the push member;

the barrel includes a main part and a head part designed to be assembled together, the opening in the side of the barrel has a first portion formed on the main part and a second portion formed on the head part, and the first portion has an extent in the longitudinal direction at least equal to the extent of the control member in this direction;

the complementary locking member provided on the barrel is formed by a first hole arranged in alignment behind the first portion of the opening in the side and suitable for being passed through by the locking member of the push member, and a second hole is formed in alignment behind the first hole and is suitable for receiving the locking member when the cartridge is in the retracted position;

the main part of the barrel includes at the front of the first portion of the opening in the side a tubular fixing part provided with fixing means for assembly with the head part, and the tubular fixing part has a slot extending longitudinally in the extension of the first portion, the slot having a width suitable for allowing the control member to pass through during fitting;

the barrel has a central longitudinal axis and includes a housing extending parallel to the axis and adjacent to a the rear radial adjustment means of the cartridge, the housing being designed to receive a rear portion of the flexible tubular part while holding it radially at a distance from the axis on the same side of the barrel as the opening in the side;

the barrel has a longitudinal central axis, and the front radial adjustment means is formed by a radial stop part integral with the push member, arranged in front of the control member and projecting radially outwards on one side of the push member opposite the control member, the radial stop part being designed to be supported against an inner wall of the barrel so as to hold a front portion of the flexible tubular part radially at a distance from the axis on the same side of the barrel as the opening in the side;

the push member includes two locking elements on opposite sides which extend forming a single generally cylindrical volume along a transverse axis perpendicular to the longitudinal direction of the barrel, the control member projecting between the two locking elements perpendicular to the transverse axis;

the barrel includes at least two complementary locking elements on opposite sides each formed by an edge portion, in the form of an arc of circle, of an oblong hole extending through a wall of the barrel, the oblong hole forming a cam channel suitable for guiding the movement of a locking member during the movement of the cartridge between the forward position and the retracted position;

the oblong hole has dimensions suitable for making it possible to install the push member in the barrel by passing it through the hole;

the push member includes a flexible part projecting radially outwards on the side of the push member opposite the control member, the flexible part being formed by a resilient member designed to rest against an inner wall of the barrel while exerting on the push member during the movement of the latter an additional elastic return force supplementing the force provided by the flexible tubular part of the cartridge.

The invention claimed is:

1. A writing implement comprising:

a barrel extending in a longitudinal direction;

a writing cartridge provided at one front end with a tip and designed to be moved in the barrel in the longitudinal direction between a forward position in which the tip is extended and a retracted position in which the tip is retracted into the barrel; and a push member movable in the longitudinal direction and in a radial direction relative to the barrel, connected to the cartridge in order to move the barrel, comprising at least one control member extending through an opening in the side of the barrel in order to project radially outwards, and also comprising at least one locking member designed to cooperate with a complementary locking member of the barrel allowing the push member to be locked in the forward position of the cartridge, wherein a flexible tubular part of the cartridge is movable jointly with the push member and forms an elastic return member designed to exert on the push member a force directed outwards from the barrel making it possible to bring about the locking, a force exerted on the push member by a user making it possible to bring about an unlocking of the push member.

2. The writing implement according to claim 1, further comprising a front radial adjustment means and a rear radial adjustment means of the cartridge arranged in the barrel on either side of the position of the control member and designed to limit at their respective levels the movement of the flexible tubular part in the radial direction during the movement of the push member.

3. The writing implement according to claim 2, wherein the barrel has a central longitudinal axis, wherein the front radial adjustment means is formed by a radial stop part integral with the push member, arranged in front of the control member and projecting radially outwards on one side of the push member opposite the control member, the radial stop part being designed to rest against an inner wall of the barrel so as to hold a front portion of the flexible tubular part radially at a distance from the axis on the same side of the barrel as the opening in the side.

4. The writing implement according to claim 1, wherein the push member has a hole extending through, through which the flexible tubular part passes in order to bring the push member into a specific position on the tubular part.

5. The writing implement according to claim 1, wherein the barrel comprises a main part and a head part designed to be assembled together, wherein the opening in the side of the barrel has a first portion formed on the main part and a second portion formed on the head part, wherein the first portion has an extent in the longitudinal direction at least equal to the extent of the control member in this direction.

6. The writing implement according to claim 5, wherein the complementary locking member provided on the barrel is formed by a first hole arranged in alignment behind the first portion of the opening in the side and suitable for being passed through by the locking member of the push member, and wherein a second hole is formed in alignment behind the first hole and is suitable for receiving the locking member when the cartridge is in the retracted position.

7. The writing implement according to claim 5, wherein the main part of the barrel comprises at the front of the first portion of the opening in the side a tubular fixing part provided with fixing means for assembly with the head part, and wherein the tubular fixing part has a slot extending longitudinally in the extension of the first portion, the slot having a width suitable for allowing the control member to pass through during fitting.

8. The writing implement according to claim 7, wherein the barrel has a central longitudinal axis, wherein the barrel comprises a housing extending parallel to the axis and adjacent to a so-called rear radial adjustment means of the cartridge, the housing being designed to receive a rear portion of the flexible tubular part while holding it radially at a distance from the axis on the same side of the barrel as the opening in the side.

9. The writing implement according to claim 1, wherein the push member comprises at least two locking elements on opposite sides which extend forming a single generally cylindrical volume along a transverse axis perpendicular to the longitudinal direction of the barrel, the control member projecting between the at least two locking elements perpendicular to the transverse axis.

10. The writing implement according to claim 1, wherein the barrel comprises two complementary locking elements on opposite sides each formed by an edge portion in the form of circular arc of an oblong hole extending through a wall of the barrel, the oblong hole forming a cam channel suitable for guiding the movement of a locking member during the movement of the cartridge between the forward position and the retracted position.

11. The writing implement according to claim 10, wherein the oblong hole has dimensions suitable for making it possible to install the push member in the barrel by passing it through the hole.

12. The writing implement according to claim 1, wherein the push member comprises a flexible part projecting radially outwards on the side of the push member opposite the control member, the flexible part being formed by a resilient element designed to rest against an inner wall of the barrel exerting on the push member during the movement of the latter, an additional elastic return force supplementing the force provided by the flexible tubular part of the cartridge.

* * * * *